US005966759A

United States Patent [19]

Sanders et al.

[11] Patent Number: 5,966,759

[45] Date of Patent: Oct. 19, 1999

[54] MATTRESS COVER

[75] Inventors: Kurt Sanders; Hans-Christian Sanders, both of Osnabrueck, Germany

[73] Assignee: Gebr. Sanders GmbH & Co., Bramsche, Germany

[21] Appl. No.: 08/809,213

[22] PCT Filed: Jan. 10, 1996

[86] PCT No.: PCT/EP96/00075

§ 371 Date: Sep. 11, 1996

§ 102(e) Date: Sep. 11, 1996

[87] PCT Pub. No.: WO96/21379

PCT Pub. Date: Jul. 18, 1996

[30] Foreign Application Priority Data

Jan. 10, 1995 [DE] Germany ..... 295 00 329

[51] Int. Cl.[6] ..... A47G 9/00

[52] U.S. Cl. ..... 5/499; 5/497; 5/699

[58] Field of Search ..... 5/496, 497, 498, 5/499, 500, 699, 939; 442/76, 77, 153

[56] References Cited

U.S. PATENT DOCUMENTS

| | | | |
|---|---|---|---|
| 2,400,731 | 5/1946 | Armstrong | 5/500 |
| 3,493,980 | 2/1970 | Haller | 5/699 X |
| 3,530,487 | 9/1970 | Beer | 5/500 X |
| 3,581,322 | 6/1971 | Marsico | 5/699 |
| 4,429,000 | 1/1984 | Naka et al. | 442/77 X |
| 4,483,900 | 11/1984 | Goldfarb | 442/77 |
| 4,662,013 | 5/1987 | Harrison | 5/497 |
| 5,050,256 | 9/1991 | Woodcock | 5/699 |
| 5,090,074 | 2/1992 | Scales et al. | 5/699 |
| 5,189,744 | 3/1993 | Roberts | 5/497 |
| 5,217,780 | 6/1993 | Wurzer | 5/502 X |
| 5,321,861 | 6/1994 | Dancey et al. | 5/939 X |
| 5,626,950 | 5/1997 | Shimano et al. | 442/76 |

FOREIGN PATENT DOCUMENTS

| | | | |
|---|---|---|---|
| 667196 | 9/1988 | Switzerland | 5/699 |
| 2012159 | 7/1979 | United Kingdom | 5/500 |

*Primary Examiner*—Terry Lee Melius
*Assistant Examiner*—Robert G. Santos
*Attorney, Agent, or Firm*—Jordan and Hamburg LLP

[57] ABSTRACT

A mattress cover is configured such that it is made differently at the top and bottom in that under a top side material is an allergen-proof barrier layer and the bottom material is made only mite-proof in order, on the one hand, to create an effective protection against allergens, but on the other hand, to provide long wear along with sufficient air and water vapor permeability as well as good laundering qualities.

20 Claims, 4 Drawing Sheets

MATTRESS COVER

The invention relates to a mattress cover in accordance with the preamble of claim.

BACKGROUND OF THE INVENTION

Mattress covers made of a uniform permeable cover material, of cotton for example, have long been known for general use for the purpose of completely enveloping a mattress in a form that can be closed by snap fasteners, buttons or slide fasteners, or for covering the top and margins of the mattress and covering only part of its bottom. What is involved is a covering which can be removed and laundered for cleanliness and hygienic purposes.

Additional requirements for a mattress cover have arisen from the knowledge that even in a clean and hygienically maintained household, house mites normally infest mattresses in large numbers in order to take advantage of sleeping humans on the one hand by using the heat and moisture they provide, and on the other hand to obtain nourishment from the tiny skin flakes shed by humans. Especially the excrement of these house mites has been identified as one of the worst allergens, so that protection against such allergens is important not only for the great and increasing number of people suffering from "house dust" allergy, but also for the great numbers of people whose sensitivity has not yet led to physical reactions as serious as illness.

For protection against such allergens, there have been developments which are aimed at sealing a mattress hermetically. That still allows for comfortably lying on a mattress since it is still soft, but it is not comfortable climatically, since normally about one-third of the water vapor transpired from a body passes through the mattress. A completely sealed mattress thus results in a blockage of air and vapor, wetting the body, the nightclothes and the bed covering. This leads to an unhealthy and intolerable sweating, as well as to wet conditions in the surrounding textiles.

Mattress covers made of cotton fabric treated with heat and pressure, especially quilt fabrics, are being offered as bedding permeable to air and water vapor. For since it had been found by studies that the quilt fabric is not woven tightly enough to block out house mites with a body size of about 20 $\mu$m, it was hoped to create by such treatment a block against the allergens, i.e., the mite excrement with a size of less than 1 $\mu$m. Certainly no satisfactory solution can be seen in this because such heat and pressure treated fabric as novel goods can have barrier qualities, but with wear and especially laundering they are lost.

According to another proposal (DE 40 27 798 C2) the use of a polyurethane layer reinforced by a textile material, such as a polyester knit goods, can be provided as a vapor-permeable but water-tight mattress cover. But such a coating would very quickly become useless because absorbed water vapor condenses in the water-tight coating and then cannot escape. It also lacks sufficient permeability to air.

SUMMARY OF THE INVENTION

The invention is addressed to the problem of creating a mattress cover which will be permeable to air and vapor in the conventional manner and will be washable for cleanliness and hygiene, but nevertheless will create an effective and lasting barrier against allergens from the mattress.

According to the invention, there is provided a mattress cover comprising a cover top and a cover bottom. The cover top includes an upper textile material layer overlying an allergen-proof and water vapor permeable layer, and the cover bottom is formed of a material which is only mite-proof.

It has proven to be important for the practical use of such a mattress cover that it is differently configured on the top and the bottom and presents an allergen-proof configuration on the upper side. This limits the special allergen-proof make-up to the critical area of the surface for the user's body to lie upon and which is dangerous regarding the upward penetration of allergens. At the same time the allergen-proof layer is provided inside (on the back) of the upper-side material, so that the body-side surface is to be made of a conventional skin-friendly material such as, for example cotton, which also absorbs moisture.

In contrast, the bottom material is made only mite-proof in order to prevent insofar as possible the entry (and departure) of a mite population. Such a bottom material, however, can thus be made much more permeable to air, so that the mattress inside of it is very well ventilated from the underside. Blocked moisture and heat which can occur in mattresses that are largely sealed all around and then also aggravate unhealthy conditions by the formation of mildew, can be prevented in this manner.

Advantageously the to material of the mattress cover can consist of a single-ply fabric in which a cotton fabric bears directly on its back an allergen-proof layer in the form of a coating. In view of the thinness of such a coating so important to vapor permeability a cotton fabric is to be worked smooth on its coated side. The advantage of such a single-ply cover material in comparison to a two-ply configuration of cover material and barrier layer lies in the possibility of not having to make the barrier layer self-supporting, so that it can be made desirably fine, especially as regards vapor permeability, and for ruggedness it uses the cotton fabric as support. A cover material of this kind can be made washable. In addition, the single-ply embodiment is desirable for the avoidance of any gap between the outer material and the barrier layer in which mites might colonize.

Especially advantageous is a complete separability of the mattress cover into two parts, one comprising the top material and the other the bottom material so that, for example, the much more heavily stressed top material can be washed more frequently. It is then unnecessary to take up the mattress and remove the mattress cover as a whole. Instead the mattress cover can be washed at rough time intervals, while the top material can be washed between shorter intervals of time.

An embodiment of the invention is represented in the drawing, and will now be further described.

DESCRIPTION OF THE PREFERRED EMBODIMENTS

Figure 1:
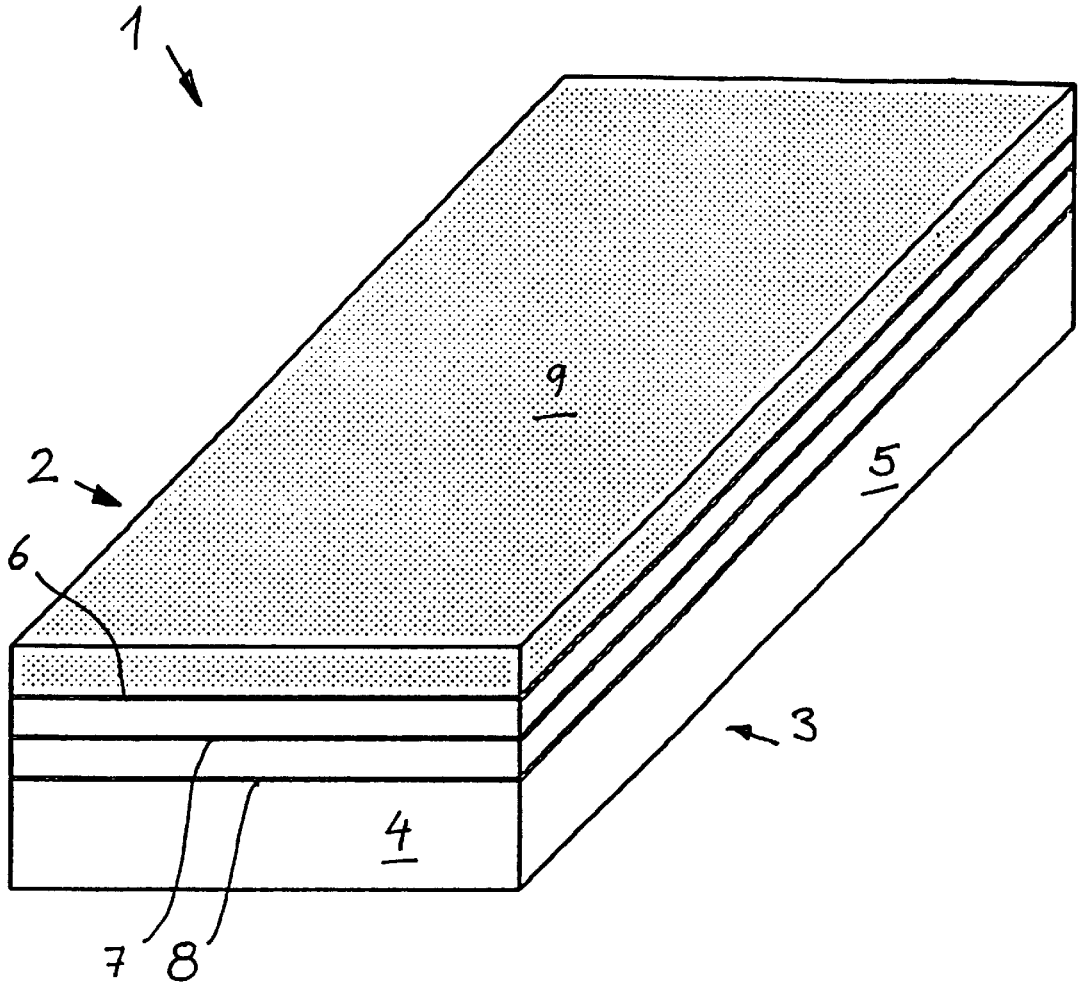
FIG. 1 is a view of a mattress cover seen in perspective from above at an angle.

The mattress cover identified as a whole by 1 in FIG. 1, and in its applied form drawn onto a mattress, is typically designed for a one-piece individual mattress. It is of course to be understood that such a mattress cover can assume the form of a single mattress of a ("French") double bed, two mattresses together for a double bed, or even three or even six mattresses of the formerly more common (triple) form.

The mattress cover consists of two parts completely separable from one another, namely a top part 2 and a bottom part 3, the top part and bottom part being joined together by a divisible slide fastener 6 running along the sides 4 and 5. Such a slide fastener offers a strong, flexible, continuous textile joining means which is what is here required. Basically, however, other joining means can be used, such as snap fastener strips, say in combination with scaling seams or strips.

Two other sides with slide fasteners (slide fastener halves 7 and 8) are additionally applied to the bottom part 3 and run parallel to slide fastener 6, so that one side of the slide fastener 6, which is fastened to the upper part 2, can be joined to the slide-fastener sides 7 or 8 if a mattress of lesser thickness is to be ordered. Inaccuracies or variations in the mattress thickness, or also uncertainties of a purchaser of a mattress regarding the mattress thickness, which is hard to determine in the case of a slightly rounded-edge mattress, and also the need to be able to use the mattress cover on another mattress if necessary, make it appear advantageous for the mattress cover 1 to be adaptable to different mattress thicknesses.

The upper part 2 comprises especially the top side 9 of the mattress cover 1, and beside it an adjoining marginal strip on the sides 4 and 5 and the margins, not shown, of the mattress cover 1, the latter resulting especially from the need to obtain a smooth, undisturbed top side and to shift seams such as the slide fastener to the margins. This, however, also opens the above-mentioned possibility of thickness matching by the different slide fasteners 6, 7, 8.

The upper part 2 consists of a cotton material which has proven desirable in connection with its moisture absorption (sweat absorption) and its permeability to vapor in the bedding area. It is obvious that, basically, any other likewise body-friendly fiber or fabric mixture can be used. A quilt fabric is used to advantage on account of its proven manufacturing possibilities, strength and stability, for example in a thread fineness of Nm 70/1 (70 km/kg). Thus a surface having good practical qualities is assured.

The functional properties of the upper part 2 are very substantially determined by a polyurethane less than 50 $\mu$m thick (30 $\mu$m, for example) underlying the material of the top part, one of which is so dimensioned and adjusted that it is permeable to water vapor, yet constitutes a reliable barrier against allergens, especially against mite excrement with a magnitude of about 1 $\mu$m. According to the standard, DIN 53122/Klima B, the water vapor permeability amounts to about 1300 g/m$^2$d. For this purpose the top material of upper part 2 is crinkled and on its back facing the mattress it is smoothed, rather slickened, in order to take the barrier layer as a coating. The surface material and coating are then bonded together gaplessly to a thickness of about 220 $\mu$m, the surface material serving also as a protector and support for the coating.

The bottom part 3 consists of an underside material rendered mite-proof and in turn forms a bottom 10 of the mattress cover (FIG. 2), plus the areas of the sides not covered by the upper part 2, including the sides 4 and 5. The bottom part 3 is here too made of a quilt fabric which on the basis of its tight weave with about 85% relative density holds out mites. Such a fabric, which is typically a twill, with a yarn fineness of Nm 40/1, i.e., with a yarn that gives a thread length of 40 kilometers per kilogram of yarn weight, is on the one hand dense and tight, but on the other hand is permeable in a known manner to air and water vapor.

Figure 2:
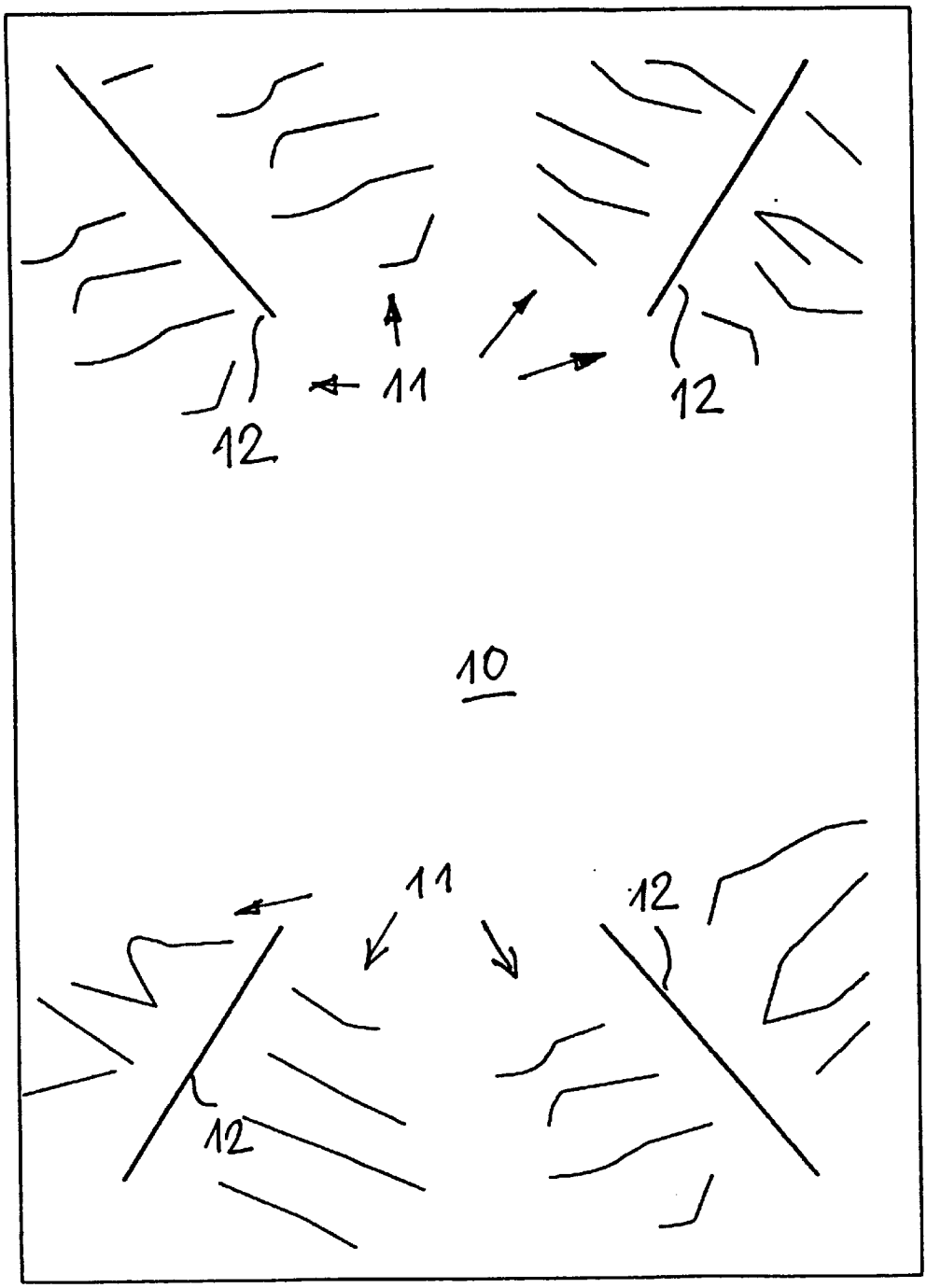
FIG. 2 is a bottom view of the mattress cover of FIG. 1.
Figure 2:
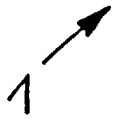

As it can be seen in FIG. 2, the bottom has pleats 11 at all four corners which are produced by diagonally running elastic tapes 12 sewn in the mattress cover (on the mattress side). These pleats serve on the one hand to secure the mattress and its support against shifting, especially when the upper part is removed, so as to maintain the mattress and the mattress cover's bottom part in place. Furthermore, these elastic pleats 11 create an improved seating of the mattress at the corners, inasmuch as mattresses are regularly more or less rounded at the corners.

Figure 3:
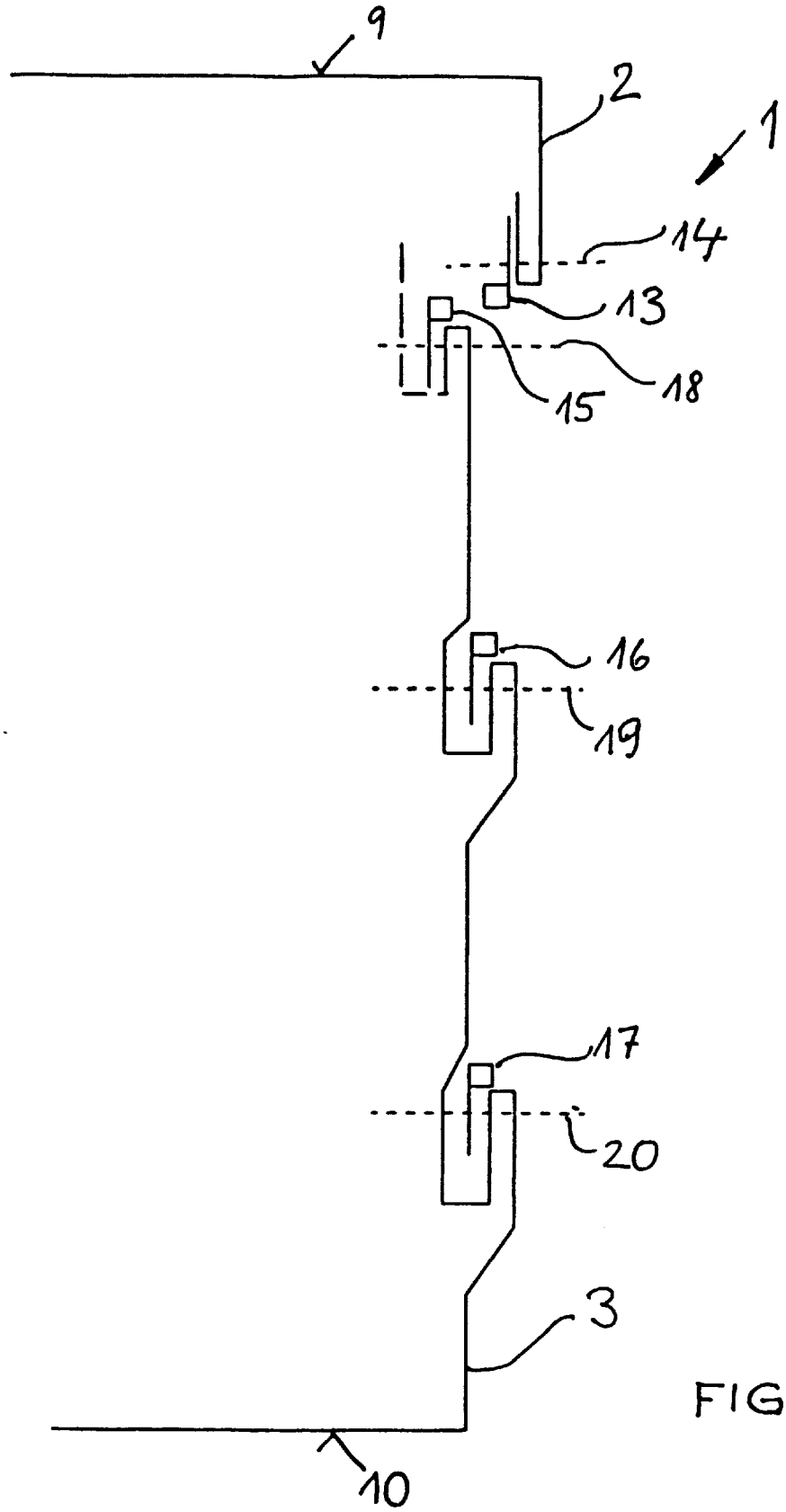
FIG. 3 is a section through one edge of the mattress cover.

FIG. 3 is a schematic representation of a section taken through the mattress cover 1, for instance in the side 5. The upper part 2 with the top surface 9 terminates in a slide fastener 13, the material of the upper part being folded in to form a neat edge, and is sewn to one side of the slide fastener with a seam 14. The bottom part 3 has three slide fastener sides 15, 16, 17, matching the slide fastener side 13 of the upper part 2, which are also sewn with a seam 18, 19, 20, respectively, represented by broken lines. As it can be seen especially at the slide fastener sides 16 and 17, these are sewn into a longitudinal double fold of the bottom material, so that the bottom material is held all the way along and inwardly envelops the slide fastener sides. Thus mite resistance is also assured at the bottom in case the slide fastener sides present openings in the seam area when installed. Even in the area of the slide fastener side 15, which in the present case (solid line) is to be sewn only to one back-folded margin of the bottom part 3, like the slide fastener side 13, an upstanding flap stitched on the inside to the slide fastener side 15 can be provided in order to create an even better mite barrier.

Figure 4:
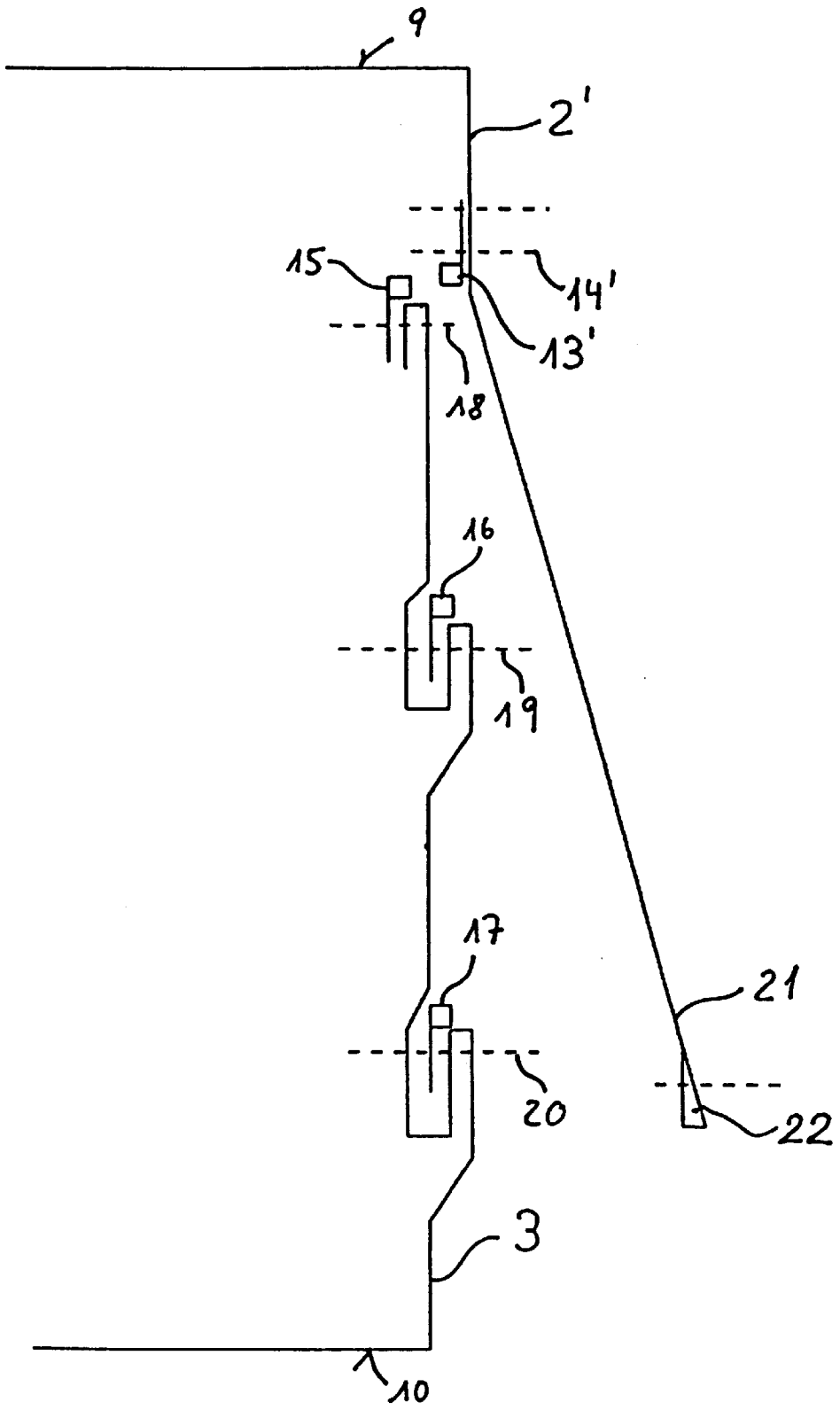
FIG. 4 is a section corresponding to FIG. 3 through a variant mattress cover.

In FIG. 4, also in section as in FIG. 3, there is shown a variant mattress cover in which the bottom part 3 corresponds to the bottom part shown in FIG. 3, and it is provided in general and in detail with the same reference numbers.

An upper part 2' with an inner slide fastener 13' has an overhang 21 extending downward from its border to such an extent that it covers the slide fastener sides of the bottom part 3. This covering of the slide fastener sides is advantageous to appearance and use because the slide fastener sides are not exposed to view and covers over the "scratchy" metal parts.

It is especially important, however, that good protection be provided on the sides against penetration of mites into the mattress, against penetration of skin particles into the mattress and against the escape of allergenic particles.

In this regard, the overhang 21 can be made advantageously from the same allergen-proof material as the material on the upper side 9, by forming a continuation thereof, for example. On its sides it can also be provided, especially on the inner side, with a bonded covering or padding to protect it from rubbing against the slide fasteners.

For an advantageously snug fit it can be provided with a hollow hem 22 for an elastic band to draw it tightly against the bottom part 3 and the mattress.

In the above embodiments the upper part is provided with a slide fastener side and the bottom part has three slide fastener sides. Both the upper part and the bottom part can be equipped with two or more slide fastener sides, also at different distances apart, in order to create possible combinations for fitting the mattress cover to a mattress side.

We claim:

1. A mattress cover for covering a mattress, comprising:

a cover top for covering a top mattress surface of the mattress and a cover bottom for covering a bottom mattress surface of the mattress;

connection means for connecting said cover top of said cover bottom about a periphery of the mattress;

said cover top having an upper surface formed of textile material layer which overlies an allergen-proof and water vapor permeable layer having a first degree of permeability which prevents passage of allergens therethrough while permitting passage of water vapor; and said cover bottom being formed of a mite-proof material having a second degree of permeability which prevents passage of mites therethrough, said second degree of permeability permitting greater permeability to air and water vapor than said first degree of permeability of said allergen-proof and water vapor permeable layer so as to prevent formation of mildew on a mattress covered by said mattress cover while not preventing passage of allergens.

2. A mattress cover according to claim 1 wherein said textile material layer has an inner side opposite said upper surface, said allergen-proof and water vapor permeable layer being a coating on said inner side of said textile material layer.

3. A mattress cover according to claim 1 wherein said textile material layer and said allergen-proof and water vapor permeable layer form a single ply, said textile material layer providing a support for said allergen-proof and water vapor permeable material layer.

4. A mattress cover according to claim 1 wherein said cover top is devoid of any gaps between said textile material layer and said allergen-proof and water vapor permeable layer.

5. A mattress cover according to claim 1 wherein said textile material layer and said allergen-proof and water vapor permeable layer are bonded to one another.

6. A mattress cover according to claim 1 wherein said textile material layer is a cotton fabric.

7. A mattress cover according to claim 2 wherein said coating of said allergen-proof and water vapor permeable material comprises a polyurethane material of a thickness of less than 50 $\mu$m.

8. A mattress cover according to claim 7 wherein said mite-proof material layer of said cover bottom is a cotton fabric that is a twill made of a yarn with a fineness of at least Nm 40/1.

9. Mattress cover according to claim 1 wherein said mite-proof material of said cover bottom is a dense cotton fabric.

10. Mattress cover according to claim 6 wherein said cotton fabric at said upper surface of said textile material layer is crinkled and said cotton fabric has a smooth lower surface opposite said upper surface.

11. A mattress cover according to claim 1 wherein said cover bottom has corner areas, and pleats disposed diagonally in said corner areas, said pleats including elastic bands.

12. A mattress cover according to claim 1 wherein the mattress on which said mattress cover is received has mattress sides extending between said top mattress surface and said bottom mattress surface and wherein said connection means includes:

said cover top having side portions for disposing about an upper part of said mattress sides;

said cover bottom having side sections for disposing about a lower part of said mattress sides; and detachable connecting means provided for detachably connecting said side portions to said side sections.

13. A mattress cover according to claim 12 wherein said detachable connecting means includes a slide fastener.

14. A mattress cover according to claim 1 wherein the mattress on which said mattress cover is received has a mattress side extending between said top mattress surface and said bottom mattress surface, said mattress side having an upper part, a lower part and an intermediate part between said upper part and said lower part, and wherein said connection means includes:

said cover top having an upper side portion for disposing about said upper part of said mattress side;

said cover bottom having a lower side section for disposing about said lower part of said mattress side;

said mattress cover having at least one intermediate side strip attached to one of said upper side portion and said lower side section for disposing about said intermediate part of said mattress; and detachable connecting means for detachably connecting said intermediate side strip to another one of said upper side portion and said lower side section.

15. A mattress cover according to claim 14 wherein: said detachable connecting means includes first and second connecting portions which are detachably engageable with one another;

said first connecting portion being disposed on said intermediate side strip; and said second connecting portion being disposed on said another one of said upper side portion and said lower side section for detachably connecting said intermediate side strip to said another one of said upper side portion and said lower side section.

16. A mattress cover according to claim 14 wherein:

said detachable connecting means includes first connecting portion and at least second and third connecting portions engageable with said first connecting portion;

said first connecting portion being disposed on said another one of said upper side portion and to said lower side section; and said second and third connecting portions being disposed on said intermediate side strip at different heights on said intermediate side strip such that said first connecting portion is engageable with either of said second and third connecting portions to permit said mattress cover to accommodate mattresses having different thicknesses.

17. A mattress cover according to claim 1 wherein said mite-proof material layer of said cover bottom is a cotton fabric that is a twill made of a yarn with a fineness of at least Nm 40/1 and a yarn weight of 40 kilometers per kilogram, the twill having a relative density of about 85%.

18. A mattress cover according to claim 1 wherein said allergen-proof and water vapor permeable layer prevents passage of allergens having a dimension of about 1 $\mu$m.

19. A mattress cover according to claim 1 wherein said connection means includes means for detachably connecting said top cover with said bottom cover such that said top cover is completely disconnectable from said bottom cover.

20. A mattress cover according to claim 14 wherein said detachable connecting means permits said top cover to be completely detached from said bottom cover.

* * * * *